United States Patent [19]

Sugiyama et al.

[11] 4,405,001

[45] Sep. 20, 1983

[54] OVERFLOW PREVENTING VALVE APPARATUS

[75] Inventors: Shigeo Sugiyama, Fujisawa; Masahiro Soya, Kawasaki; Tugio Nagashima, Yokosuka, all of Japan

[73] Assignee: Tokico Ltd., Japan

[21] Appl. No.: 302,833

[22] Filed: Sep. 16, 1981

[30] Foreign Application Priority Data

Sep. 16, 1980 [JP] Japan ..... 55-131373

[51] Int. Cl.[3] ..... B65B 57/14

[52] U.S. Cl. ..... 141/220; 137/414; 141/229; 222/14; 251/29; 251/32; 251/45

[58] Field of Search ..... 137/413, 414; 251/45, 251/28, 29, 32; 141/94, 192, 198, 206–229, 311 A, 392; 222/14, 15, 16

[56] References Cited

U.S. PATENT DOCUMENTS 4,106,536 8/1978 Coquerel ..... 141/229 X

FOREIGN PATENT DOCUMENTS 56-62476 5/1981 Japan .

*Primary Examiner*—Frederick R. Schmidt

*Attorney, Agent, or Firm*—Steele, Gould & Fried

[57] ABSTRACT

An overflow preventing valve apparatus comprises a valve main body provided at a terminal end of a fluid supplying system passage, a main valve fixed to a separating membrane stretched within the valve main body to separate an upper chamber and a lower chamber, when the main valve is displaced upwards and downwards accompanied by deformation of the separating membrane and closing a fluid supplying passage upon moving downwards, a pilot valve for opening and closing the main valve in response to the opening and closing of the pilot valve itself, where the pilot valve is opened by a fluid supply starting operation, a lock mechanism for locking the pilot valve in an open state, a first lock releasing mechanism responsive to the detection of a dangerous fluid level which could lead to an overflow, for releasing the locking operation by the lock mechanism to close the pilot valve, and a second lock releasing mechanism responsive to the closing operation of the main valve at the time when the supply of fluid is stopped, for releasing the locking operation by the lock mechanism to close the pilot valve.

8 Claims, 11 Drawing Figures

OVERFLOW PREVENTING VALVE APPARATUS

BACKGROUND OF THE INVENTION

The present invention generally relates to overflow preventing valve apparatuses, and more particularly to an overflow preventing valve apparatus provided at a final end of a fluid supplying system in a fluid supplying apparatus constructed to release the locking operation with respect to a pilot valve which is in an open state for controlling open and closed states of a main valve to close the pilot valve, in a case where the main valve closes in response to the closing of a stop valve within a fluid supplying system passage, for example, in addition to a case where a dangerous fluid level indicating possible occurrence of overflow is detected.

Generally, a fluid supplying apparatus for supplying fluid to a tank rulley and the like from a storage tank, is provided with a flowmeter for measuring a predetermined flow quantity of fluid disposed within a fluid supplying system passage, a stop valve, and an overflow preventing valve having a drop pipe, provided at a final end of the fluid supplying system passage. When fluid of predetermined quantity is supplied into a tank of the tank rulley, the stop valve is automatically closed due to a signal supplied from the flowmeter for measuring a predetermined flow quantity of fluid, to stop the fluid supplying operation. Furthermore, in a case where the fluid supplying apparatus becomes inoperative and the fluid is excessively supplied into the tank to possibly introduce an overflow state, the overflow preventing valve detects the abnormal fluid level and closes, to stop the fluid supplying operation.

The conventional overflow preventing valve is constructed to drive and close the main valve provided at the inner part of the fluid supplying apparatus by use of a driving source such as hydraulic and pneumatic sources, when the overflow preventing valve detects the abnormal fluid level within the tank. Accordingly, a driving source is required exclusively for driving to open and close the main valve. Therefore, the construction of the apparatus became complex, and there was a disadvantage in that the operational cost became high.

Hence, in order to eliminate the above described disadvantages, the present applicant has previously proposed an overflow preventing valve provided with a pilot valve, in which the pilot valve is opened and closed to open and close the main valve. According to the above overflow preventing valve, the locking operation with respect to the pilot valve in the open state can be positively released to close the pilot valve and then close the main valve, even in a case where a pressure signal obtained as a result of detecting the abnormal fluid level is of a very small pressure value. Thus, the main valve can be closed without requiring a special driving source.

However, in the above proposed overflow preventing valve, the main valve closes automatically when the fluid supplying operation is stopped due to the closing of a stop valve provided within the fluid supplying system passage, but the pilot valve remains locked in the open state. Accordingly, the fluid within a chamber provided with the pilot valve leaks to the side of a drop pipe, and excessive fluid is supplied into the tank. Hence, there was a problem in that degradation is introduced in the accuracy of the operation to supply fluid of predetermined quantity. Moreover, the fluid leaks outside the tank from the drop pipe when the drop pipe is transferred to another tank, and was especially dangerous when the fluid is gasoline and the like.

Accordingly, a method can be considered in which a special manipulation lever is provided at an outer part of the overflow preventing valve, and the manipulating lever is manipulated when the stop valve closes to release the locking operation with respect to the pilot valve and close the pilot valve. However, this method is troublesome in that the manipulation lever must be manipulated every time the fluid supplying operation is completed with respect to each tank, and the operation efficiency accordingly becomes low. In addition, there is a possibility for the operator to forget to manipulate the above manipulation lever, and should this situation occur, the same problems introduced in the above case are then introduced.

SUMMARY OF THE INVENTION

Accordingly, it is a general object of the present invention to provide a novel and useful overflow preventing valve apparatus in which the above described problems have been overcome.

Another and more specific object of the present invention is to provide an overflow preventing valve apparatus provided with a mechanism for releasing a locking operation with respect to a pilot valve in an open state by a closing operation of a main valve, in which the pilot valve is closed accompanied by the closing of the main valve. According to the apparatus of the present invention, a completely stopped state of the fluid supplying operation can be obtained, to improve the accuracy of the operation in which fluid of predetermined quantity is supplied. Moreover, the stability of the apparatus can be improved, and further, the operation efficiency of the fluid supplying operation can be improved.

Other objects and further features of the present invention will be apparent from the following detailed description when read in conjunction with the accompanying drawings.

DETAILED DESCRIPTION

Figure 1:
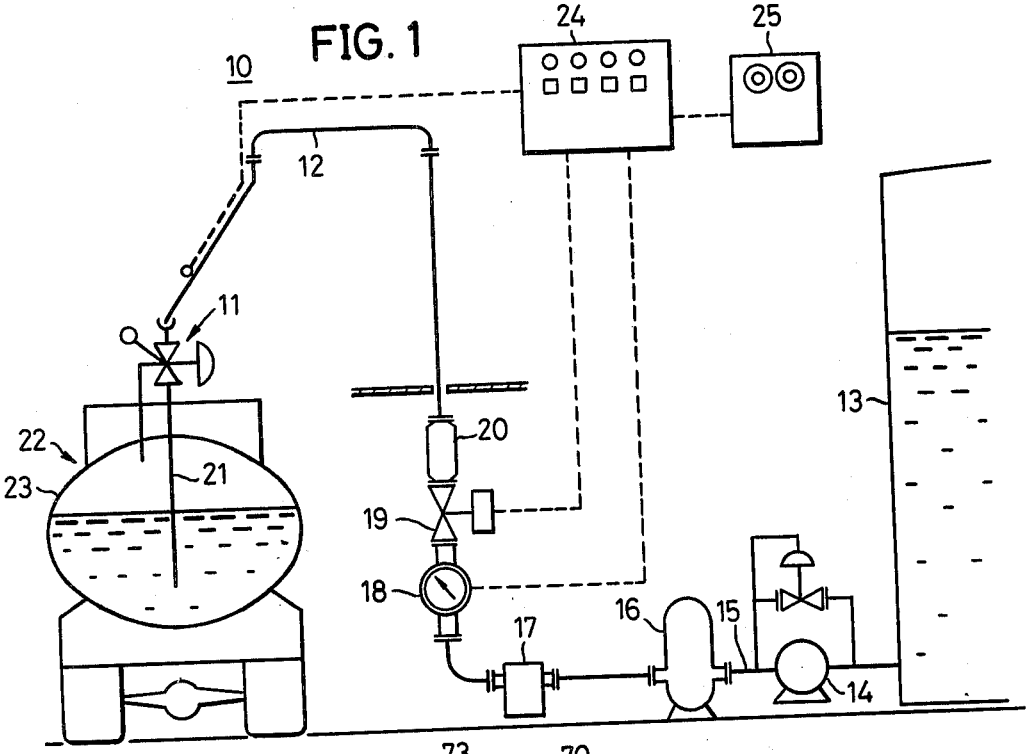
FIG. 1 is a diagram substantially showing an example of a fluid supplying apparatus applied with an overflow preventing valve apparatus according to the present invention.

FIG. 1 is a diagram showing a fluid supplying apparatus 10. An overflow preventing valve apparatus 11 according to the present invention is provided at the tip end of a loading arm 12. Fluid within an underground tank 13 is supplied under pressure into a fluid supplying pipe arrangement 15 by a pump 14, and then supplied to the loading arm 12 through an air separator 16, a strainer 17, a flowmeter 18 for measuring a predetermined flow quantity of fluid, a stop valve 19 which is in an open state and a valve 20 responsive to a predetermined flow quantity of the fluid. Hence, the fluid is supplied into a tank 23 of a tank rulley 22 from a drop pipe 21 of the overflow preventing valve apparatus 11 provided at the tip end of the loading arm 12. The above flowmeter 18 and the stop valve 19 are electrically connected to a control panel 24. When the flowmeter 18 measures and counts up to a predetermined flow quantity of fluid, the stop valve 19 closes and the supply of fluid into the tank 23 is stopped. In addition, the above control panel 24 is electrically connected to an electronic calculator 25.

Figure 2:
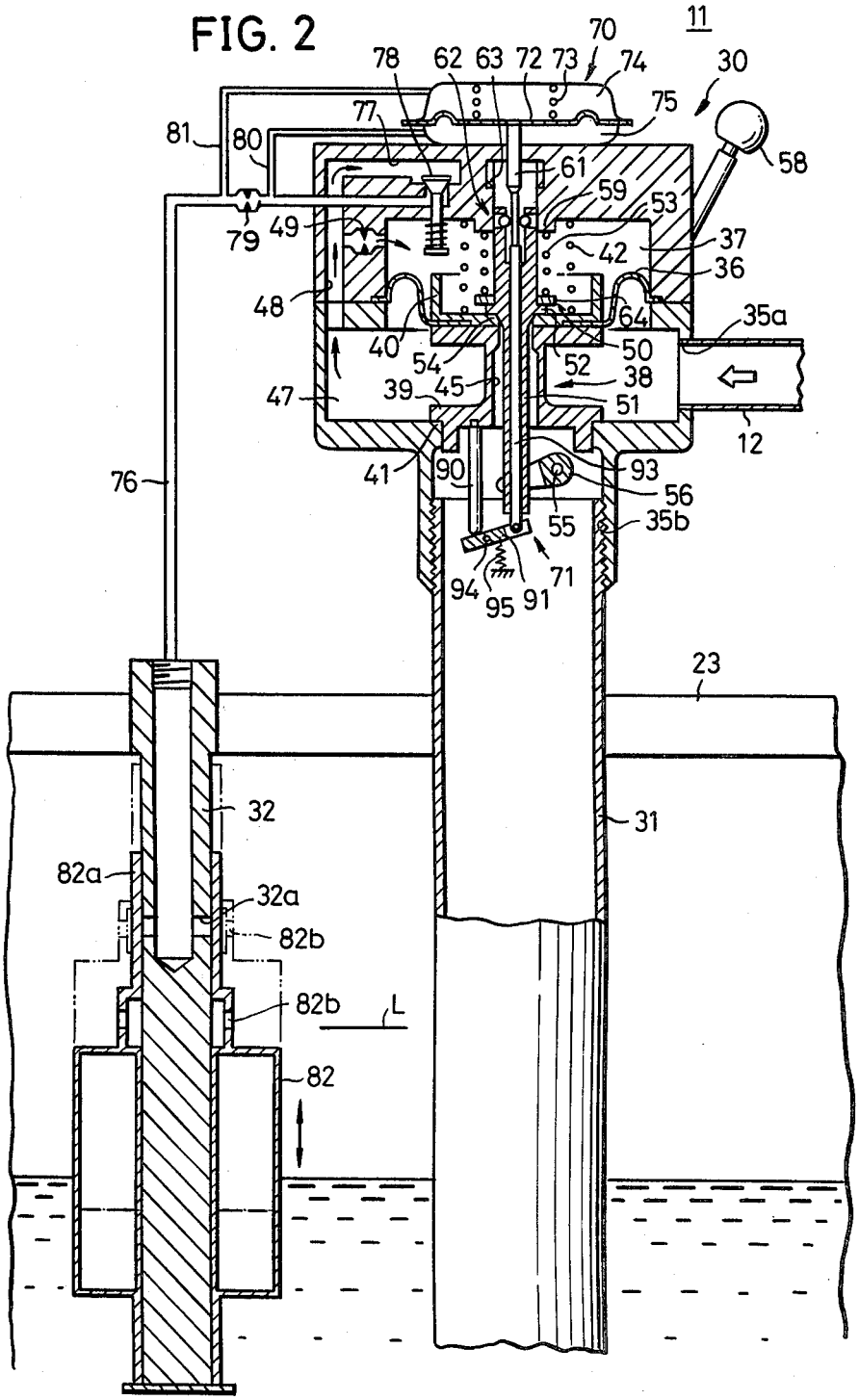
FIG. 2 is a diagram showing an embodiment of an overflow preventing valve apparatus according to the present invention in a vertical cross section.

As shown in FIG. 2, the overflow preventing valve apparatus 11 comprises an overflow preventing valve main body 30 having a drop pipe 31 corresponding the above described drop pipe 21 fluid surface detection pipe 32. The drop pipe 31 and the fluid surface detection pipe 32 are inserted into the tank 23.

Figure 3:
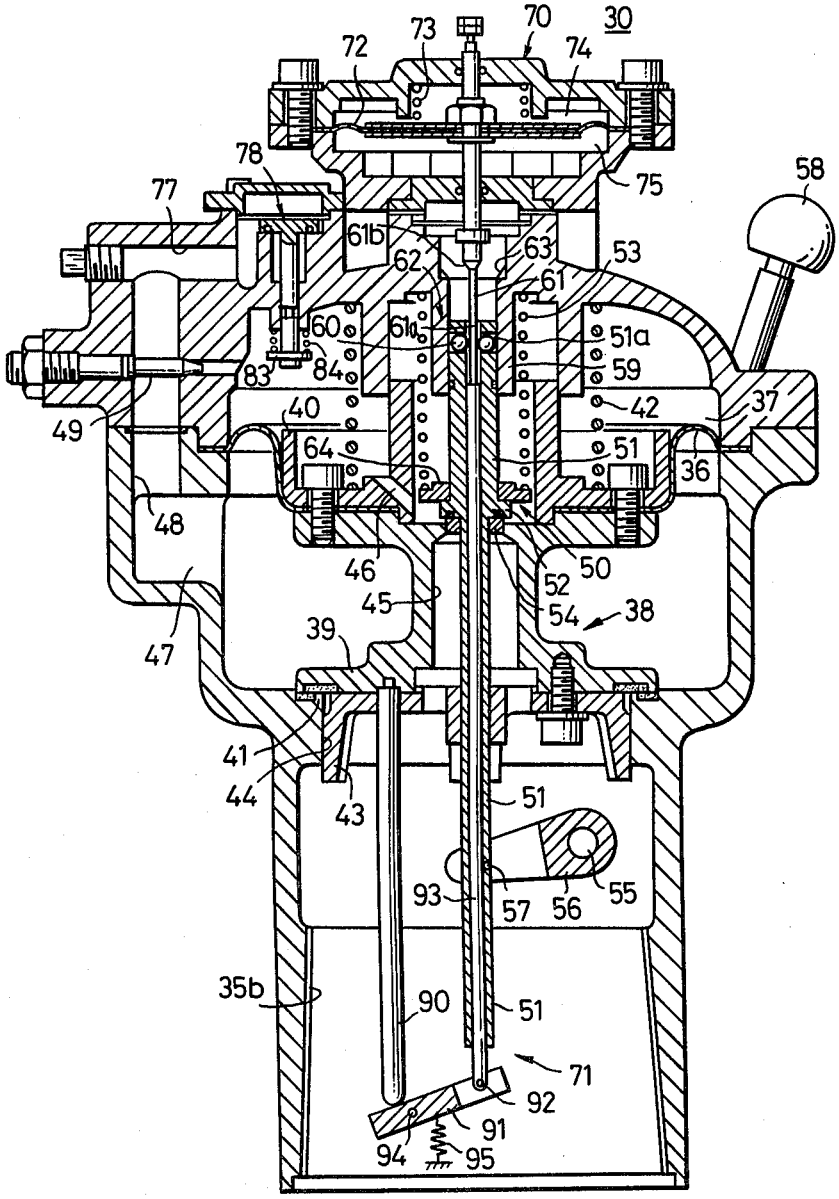
FIG. 3 is a diagram showing an inner construction of an overflow preventing valve main body of an overflow preventing valve apparatus according to the present invention in a vertical cross section.

In FIGS. 2 and 3, the valve main body 30 is provided at the tip end of the loading arm 12 in a state where a flow entrance 35*a* is connected to the loading arm 12, and the drop pipe 31 is connected to a flow exit 35*b* in a hanging manner. A diaphragm 36 is provided at the inner part of the valve main body 30 in a stretched state, to form a diaphragm chamber 37 and an entrance chamber 47. A valve body 39 of a main valve 38 is mounted at the center of the above diaphragm 36 by a diaphragm holder 40. The valve body 39 is substantially of an I-shape in cross section, and moves upwards and downwards accompanied by the deformation of the diaphragm 36, to separate and sit with respect to a valve seat 41. The main valve 38 is urged in the downward direction (closing direction) by a compressed coil spring 42, and is in a closed state before starting of a fluid supplying operation. A ring-shaped rib structure 43 having a hanging rib at four positions, is fixed to the lower surface of the valve body 39 by screws. The above rib structure 43 fits into a cylindrical part 44 at the inner side of the valve seat 41. A fluid discharge passage 45 is provided at the inner part of the valve body 39. Moreover, a hole 46 is formed in the diaphragm holder 40.

The above diaphragm chamber 37 and the entrance chamber 47 are interconnected through a fluid supplying passage 48 and a throttle valve 49.

A pilot valve 50 consists of a long and narrow pipe body 51 and a flange part 52 provided at an intermediate part of the pipe body 51, and passes through the center of the valve body 39. The pilot valve 50 is provided in a state freely movable upwards and downwards under sliding contact. Moreover, the above pilot valve 50 is urged towards the downward direction (closing direction) by a compressed coil spring 53 fitted between a spring receiving part 64 and the inner wall of the valve main body 30. Before starting of the fluid supplying operation, the pilot valve 50 sits on a valve seat 54 provided on the main valve 38.

The lower end side of the pipe body 51 is connected to a rotary arm 56 fixed to a handle shaft 55, by a pin 57. A handle 58 which is manipulated upon starting of the fluid supplying operation, is provided on the handle shaft 55.

The upper end side of the pipe body 51 is inserted into a hanging cylindrical part 59 of the valve main body 30 in a freely slidable manner. Furthermore, stopping balls 60 are fitted into holes 51*a* formed in the radial direction and provided in the vicinity of the upper end part of the pipe body 51. The above stopping balls 60 operate together with a needle 61 which is inserted within the pipe body 51, to construct a lock mechanism 62. That is, when the pilot valve 50 is in the closed state, the stopping balls 60 oppose a narrow diameter part 61*a* of the needle 61 and are fitted into the above holes 51*a* provided in the radial direction, and the lock mechanism 62 is in a unlocked state. As will be described hereinafter, when the pilot valve 50 moves upwards and opens, the stopping balls 60 are pushed by a tapered surface 61*b* of the needle 61 outside the pipe body 51 accompanied by the continual opening of the main valve 38. Accordingly, the stopping balls 60 ride over a ring member 63, and the lock mechanism 62 locks the pilot valve 50 in a state impossible to move downwards.

The valve main body 30 is provided with two lock releasing mechanisms for releasing the locking operation with respect to the pilot valve 50 which is in the open state by the lock mechanism 62. That is, the valve main body 30 is provided with a first lock releasing mechanism 70 and a second lock releasing mechanism 71. The above locking operation with respect to the pilot valve 50 which is in the open state by the lock mechanism 62, is released by the upward movement of the needle 61.

The first lock releasing mechanism 70 operates to pull up the above needle 61 when a dangerous fluid level which can lead to an overflow accident is detected, and is provided at the upper part of the valve main body 30. On the other hand, the second lock releasing mechanism 71 operates to push up the above needle 61 when the main valve 38 opens due to the completion of the fluid supplying operation, and is provided at the lower part of the valve main body 30. The above second lock releasing mechanism 71 constitutes an essential part of the apparatus according to the present invention.

In the first lock releasing mechanism 70, the upper part of the needle 61 is fixed to a diaphragm 72. This diaphragm 72 is urged towards the downward direction by a compressed coil spring 73, and chambers 74 and 75 are respectively formed at the upper and lower parts of the above diaphragm 72.

A pipe 76 is communicated with a branching passage 77 branching from the fluid supplying passage 48, and is connected to the valve main body 30. An opening and closing valve 78 is provided at an intermediate position of the above branching passage 77. The above valve 78 is normally in a closed state, and is pushed upwards by the diaphragm holder 40 when the main valve 38 is open to be put into an open state. A throttle 79 is provided at an intermediate position of the pipe 76. Pressure introducing pipes 80 and 81 respectively branch from the front and rear of the throttle 79, and these pipes 80 and 81 are respectively communicated and connected to the lower chamber 75 and the upper chamber 74.

The fluid surface detection pipe 32 is arranged at a predetermined height position in a hanging manner and fixed to the tip end of the pipe 76. A float 82 is fitted over the above fluid surface detection pipe 32, in a manner such that the float 82 is freely slidable along the fluid surface detection pipe 32.

Before starting of the fluid supplying operation, the needle 61 is pushed upwards by a long and narrow rod 93. Hence, the needle 61 is at the raised position where it is impossible to become locked, and the diaphragm 72 is displaced upwards against the force exerted by the spring 73.

The second lock releasing mechanism 71 substantially comprises a hanging rod 90 fixed in a hanging manner to the lower surface of the valve body 39 of the main valve 38, a rotary arm 91 which is pushed at one end side thereof and rotated towards the counterclockwise direction by the lowering rod 90 upon seating of the valve body 39, and the long and narrow rod 93 which is fitted into the pipe body 51 is a freely slidable manner and connected to the other end side of the rotary arm 91 by a pin 92 at a lower end part thereof which projects from the lower end of the pipe body 51. The upper end of the long and narrow rod 93 opposes the lower end of the needle 61. The rotary arm 91 is axially supported within the flow exit **35*b* of the valve main body 30 by a pin 94, and urged to rotate towards the clockwise direction by a force exerted by a spring 95**.

When the main valve 38 is in a closed state, the second lock releasing mechanism 71 is in a state shown in FIGS. 2 and 3. That is, the rotary arm 91 is pushed by the rod 90 and rotated towards the counterclockwise direction, the long and narrow rod 93 is moved upwards, and the needle 61 is raised against the force exerted by the spring 73.

Next, description will be given with respect to the operation of the overflow preventing valve apparatus 10 having the above described construction during the fluid supplying operation, by referring to FIGS. 4 through 9.

Figure 4:
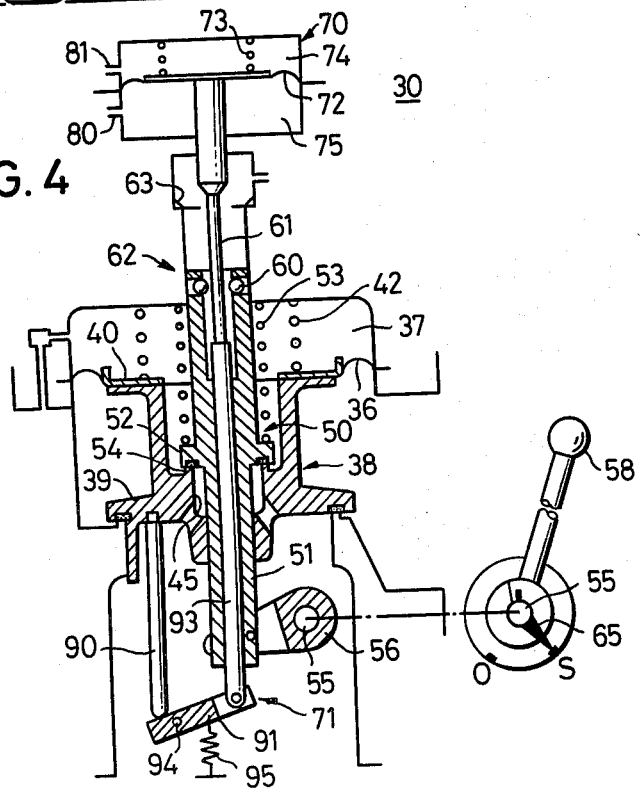
FIGS. 4, 5, 6, and 7 are diagrams respectively and substantially showing the overflow preventing valve apparatus shown in FIG. 2 in a state before starting of a fluid supplying operation, a state immediately after starting of the fluid supplying operation, a state where the main valve is about to open after starting of the fluid supplying operation and the pilot valve is locked in an open state, and a state during a continual fluid supplying operation.

Before the fluid supply to the tank 23 of the tank rulley 22 is started, the overflow preventing valve apparatus 10 is in a state shown in FIGS. 2, 3, and 4. That is, both the main valve 38 and the pilot valve 50 are closed, and the needle 61 is pushed up by the long and narrow rod 93 unto a position where it is impossible to become locked. An indication needle 65 indicates a "closed" state.

Figure 5:
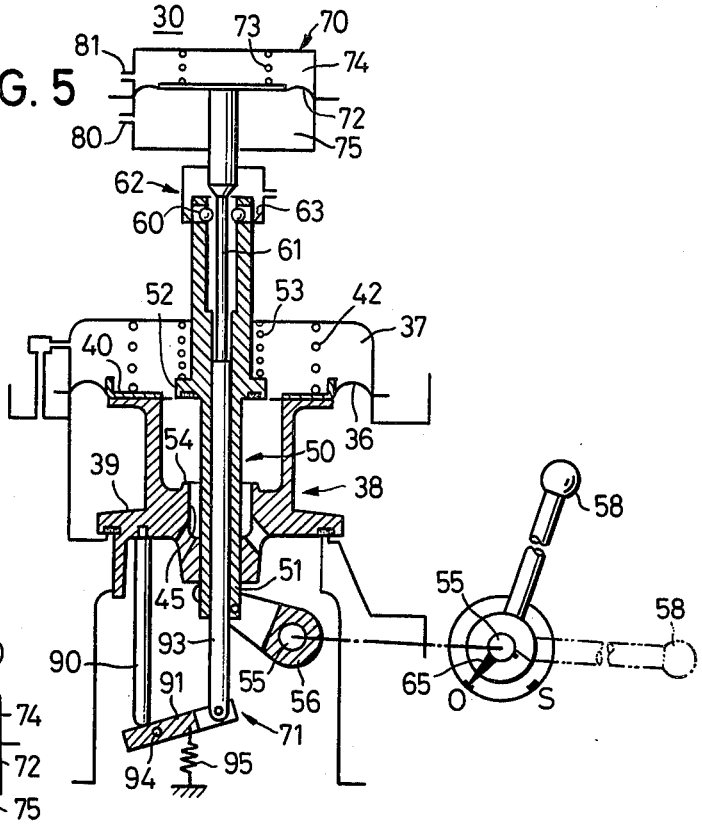

Upon starting of a fluid supplying operation, the handle 58 is rotationally manipulated towards the clockwise direction unto a rotational position indicated by a two-dot chain line in FIG. 5. FIG. 5 shows a state immediately after the handle 58 is rotationally manipulated. The above handle 58 and the handle shaft 55 are connected by a unidirectional clutch, and only the handle 58 returns to the original position indicated by a solid line in FIG. 5 due to the force of the spring when released of the manipulation. The handle shaft 55 does not return, and the indication needle 65 indicates an "open" state to indicate that the main valve 38 is in an open state.

Moreover, by the above manipulation of the handle 58, the rotary arm 56 is rotated towards the clockwise direction. Further, the pipe body 51 is moved upwards to open the pilot valve 50.

When the pilot valve 50 opens, the fluid stored within the diaphragm chamber 37 flows to the downstream side of the main valve 38, that is, to the side of the flow exit **35*b*, through the hole 46 of the diaphragm holder 40 and the fluid discharge passage 45 of the valve body 39. Accordingly, the pressure inside the diaphragm chamber 37 is lowered. Hence, the main valve 38 is displaced towards the upward direction accompanying deformation of the diaphragm 36, against the force exerted by the spring 42 due to the pressure inside the entrance chamber 47**.

Figure 6:
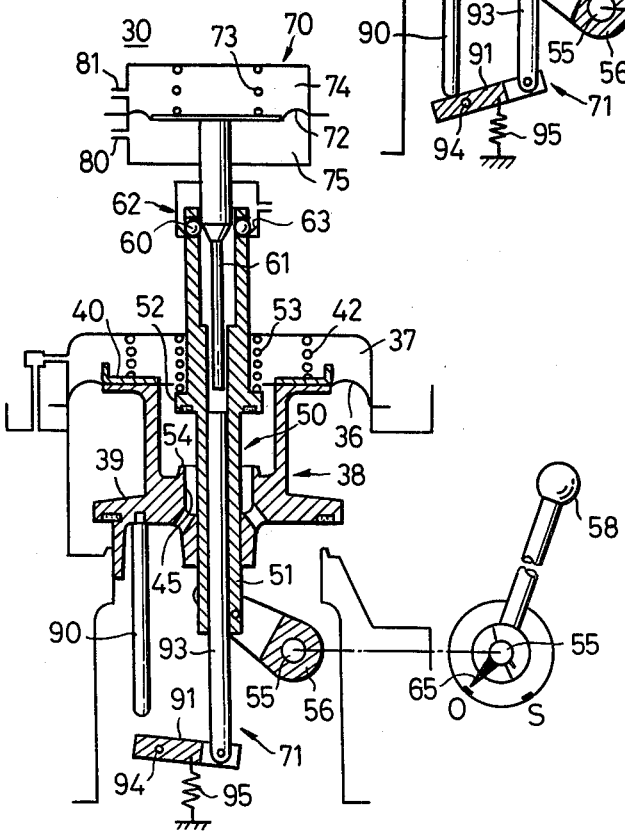

Due to the initial upward movement of the main valve 38, the rod 90 separates from the rotary arm 91 as shown in FIG. 6, and the rotary arm 91 rotates towards the clockwise direction. The long and narrow rod 93 moves downwards due to the above rotation of the rotary arm 91, and the needle 61 moves downwards by the action of the spring 73 to push the stopping balls 60 outwards by the tapered surface **61*b* thereof. Hence, a part of the respective stopping balls 60 projects outside the pipe body 51 to ride over the ring member 63. Accordingly, the pilot valve 50** becomes locked in the raised and open state.

Figure 7:
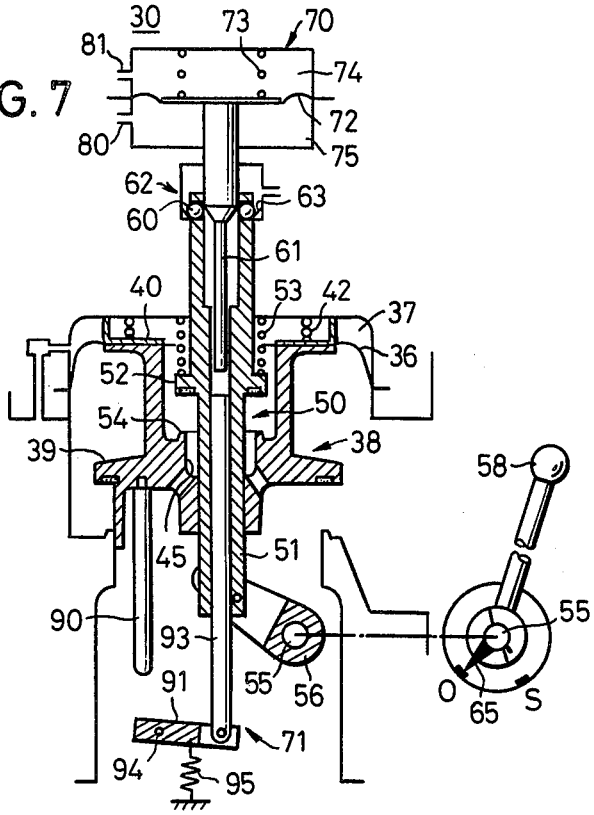

The main valve 38 moves upwards to a final position indicated in FIG. 7 and fully opens. During a final rising stage of the main valve 38, the diaphragm holder 40 pushes a valve shaft 83 of the valve 78 upwards against the force exerted by a spring 84, to open the valve 78. Since the valve 78 is opened, the fluid within the fluid supplying passage 48 is supplied inside the fluid surface detection pipe 32 through the pipe 76, and further, the fluid is supplied into the chambers 75 and 74 through the pressure introducing pipes 80 and 81. At this point in time, a hole **32*a* of the fluid surface detection pipe 32 is in a state closed by a cylindrical part 82*a* of the float 82, and no flow of the fluid is introduced within the pipe 76. Therefore, the pressure is of the same level at the front and rear parts of the throttle 79 within the pipe 76, and the diaphragm 72 and the needle 61** is maintained in the downwardly displaced states.

Furthermore, since the main valve 38 opens, the fluid inside the loading arm 12 flows within the entrance chamber 47 of the valve main body 30 as indicated by arrows in FIG. 2. The above fluid reaches to the side of the flow exit **35*b* through the main valve 38 which is in an open state, and is supplied into the tank 23 through the drop pipe 31. During continual fluid supplying operation, the inner part of the overflow preventing valve main body 30 is maintained in a state shown in FIG. 7**.

Figure 8:
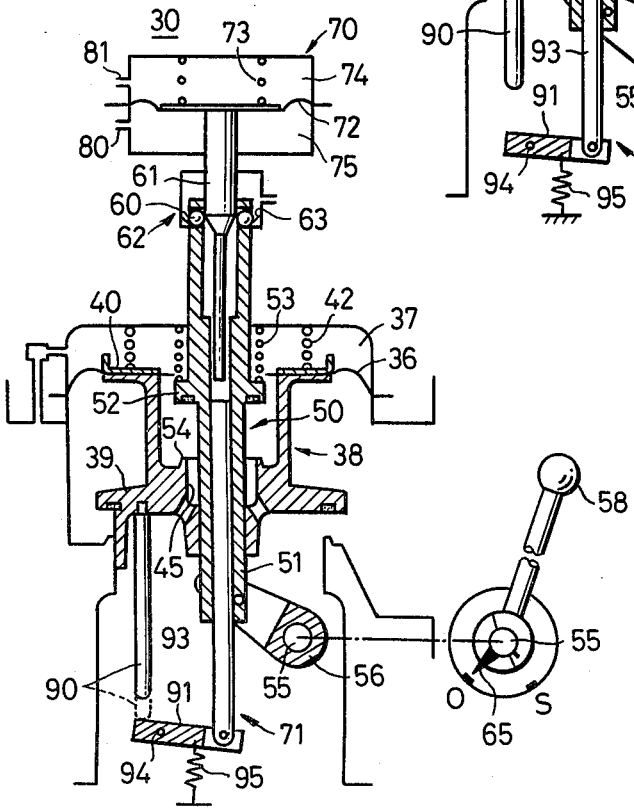
FIG. 8 is a diagram substantially showing the overflow preventing valve apparatus shown in FIG. 2 in a state where the main valve is about to close due to the stopping of the fluid supplying operation.

As the fluid supplying operation progresses and a predetermined quantity of fluid is supplied into the tank 23, the stop valve 19 shown in FIG. 1 closes, and the fluid supplying operation with respect to the tank 23 is automatically stopped. When the supply of fluid is stopped, the pressure inside the entrance chamber 47 of the valve main body 30 decreases. Hence, as shown in FIG. 8, the main valve 38 operates in a closing direction (downward direction) due to the action of the spring 42 and the valve body 39 sits on the valve seat 41, to close the main valve 38. FIG. 8 shows an initial stage in which the main valve 38 has started a closing operation. At the final stage of the valve closing operation of the main valve 38, the lower end of the rod 90 pushes one end side of the rotary arm 91 to rotate the rotary arm 91 towards the counterclockwise direction against the force exerted by the spring 95, as indicated by a two-dot chain line in FIG. 8. Due to the rotation of the rotary arm 91, the long and narrow rod 93 moves upwards to push the needle 61 towards the upward direction against the force exerted by the spring 73. When the needle 61 is pushed upwards, the stopping balls 60 enter within the holes of the pipe body 51 and separate from the ring member 63, to release the locking operation with respect to the pilot valve 50 by the lock mechanism 62. Accordingly, the pilot valve 50 is moved downwards by the action of the spring 53 and closed. Moreover, the flange part 52 sits on the valve seat 54 to close the entrance opening of the fluid discharge passage. That is, the locking operation with respect to the pilot valve 50 is released by the second lock releasing mechanism 71, and the pilot valve 50 is accordingly closed. In addition, in response to the closing of the main valve 38, the valve 78 closes to interrupt the supply of fluid with respect to the fluid surface detection pipe 32. Hence, the mechanism at the inner part of the overflow preventing valve main body 30 is returned to the original state before starting of the fluid supplying operation as shown in FIG. 4.

The force required to displace the needle 61 upwards in order to release the locking operation with respect to the pilot valve 50 which is in the open state by the above lock mechanism 62 can be small. Further, the needle 61 positively moves upwards in relation with the valve closing operation of the main valve 38. The pilot valve 50 which is released from the locking operation, is closed at a high speed due to the action of the spring 53.

Therefore, after the fluid supplying operation is stopped by the closing of the stop valve 19 (main valve 38), the fluid within the diaphragm chamber 37 is hermetically stored inside the chamber 37. Hence, the fluid inside the diaphragm chamber 37 does not flow to the side of the drop pipe 31 through the fluid discharge passage 45 as in the convention apparatus. Accordingly, the quantity of fluid supplied into the tank 23 can be determined with high accuracy, to improve the accuracy of the operation in which fluid of predetermined quantity is supplied. Furthermore, after completion of the fluid supplying operation to the above tank 23, the fluid does not flow out of the drop pipe 31 outside the tank when the drop pipe 31 is transferred to another tank. The safety factor of the fluid supplying operation is thus improved especially in the case where the fluid is gasoline and the like.

Since the above locking operation with respect to the pilot valve 50 is released automatically in relation with the stopping of the fluid supplying operation, the operation efficiency of the fluid supplying operation can be improved compared to the case where manipulation levers and the like for releasing the locking with respect to the pilot valve are provided to be manipulated after the fluid supplying operation is stopped. Moreover, no inconveniences are introduced due to an accident in which the operator forgets to manipulate the above manipulation lever.

In addition, when the pilot valve 50 moves downwards and closes, the rotary arm 56 and the handle shaft 55 rotate toward the counter clockwise direction, however, the handle shaft 55 rotates independently from the handle 58 which is already in the returned state due to the action of the uni-directional clutch. Accordingly, safety is ensured, since the handle 58 is not rotated accompanied by the closing of the pilot valve 50. That is, if the handle 58 rotationally returns in relation with the closing of the pilot valve 50, it is dangerous in that the rapidly returning handle could hit the arm or the leg of the operator.

Even in a case where the substantial supply of fluid is stopped by the stopping of the pump 14 due to a power failure or an accident, besides the case where the stop valve 19 is closed, for example, the overflow preventing valve main body 30 operates similarly as in the above described case.

Next, description will be given with respect to the operation of the overflow preventing valve apparatus 10, for a case where the fluid is excessively supplied into the tank 23 for some reason and the fluid surface reaches the dangerous fluid level which could lead to an overflow.

In FIG. 2, when fluid over a predetermined quantity is supplied and the fluid surface rises to a dangerous level L, the float 82 rises to a position indicated by a two-dot chain line in FIG. 2. The hole **82*a* coincides with the hole 32*a* of the fluid surface detection pipe 32. As a result, the fluid stored inside the fluid surface detection pipe 32 until that point, flows into the tank 23 through the holes 32*a* and 82*b*. Due to the outward flow of fluid from the fluid surface detection pipe 32, the fluid within the pipe 76 also flows. Hence, a pressure difference is introduced between the front and rear parts of the throttle 79, and the pressure inside the chamber 74** decreases.

Figure 9:
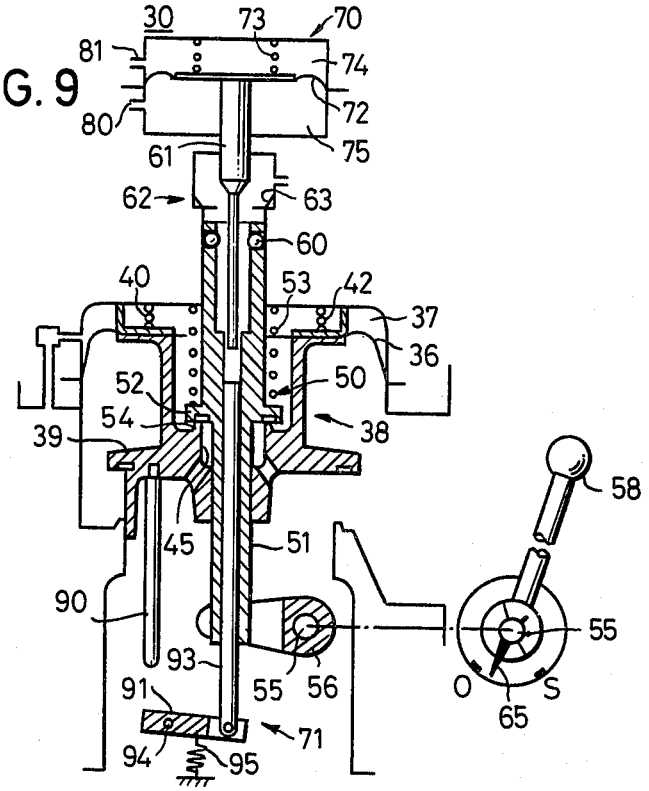
FIG. 9 is a diagram substantially showing the overflow preventing valve apparatus shown in FIG. 2 in a state where a dangerous fluid level possible of introducing overflow is detected.

Accordingly, as shown in FIG. 9, the diaphragm 72 is displaced upwards against the force exerted by the spring 73. The needle 61 is pulled upwards together with the above diaphragm 72, and the lock mechanism 62 is similarly put into a lock released state as in the above case. The pilot valve 50 thus moves downwards and closes. That is, the pilot valve 50 is released of the locking operation by the first lock releasing mechanism 70, and closed.

The mechanism for pulling the needle 61 upwards is not limited to the mechanism of the above described construction.

When the pilot valve 50 closes, the diaphragm chamber 37 is interrupted of the communication from the downstream side. Hence, the pressure within the diaphragm chamber 37 becomes large, and the diaphragm 36 is displaced downwards. Moreover, the valve body 39 of the main valve 38 is driven and closed to make contact with and sit on the valve seat 41, and the supply of fluid is accordingly stopped. Therefore, the mechanism at the inner part of the valve main body 30 is returned to the original state before starting of the fluid supplying operation, as shown in FIG. 4. FIG. 9 shows a state immediately after the main valve 38 has started a valve closing operation.

Figure 10:
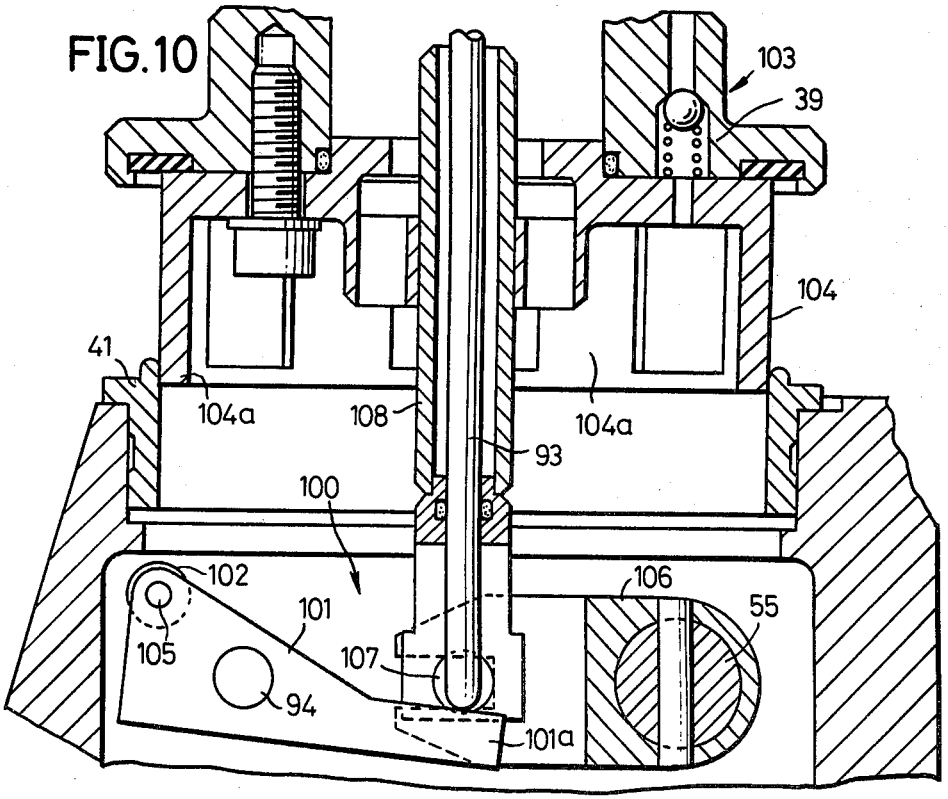
FIGS. 10 and 11 are diagrams in vertical cross section, with a part cut away, respectively showing another embodiment of an overflow valve apparatus according to the present invention in a state before operation, and in a state after operation.
Figure 11:
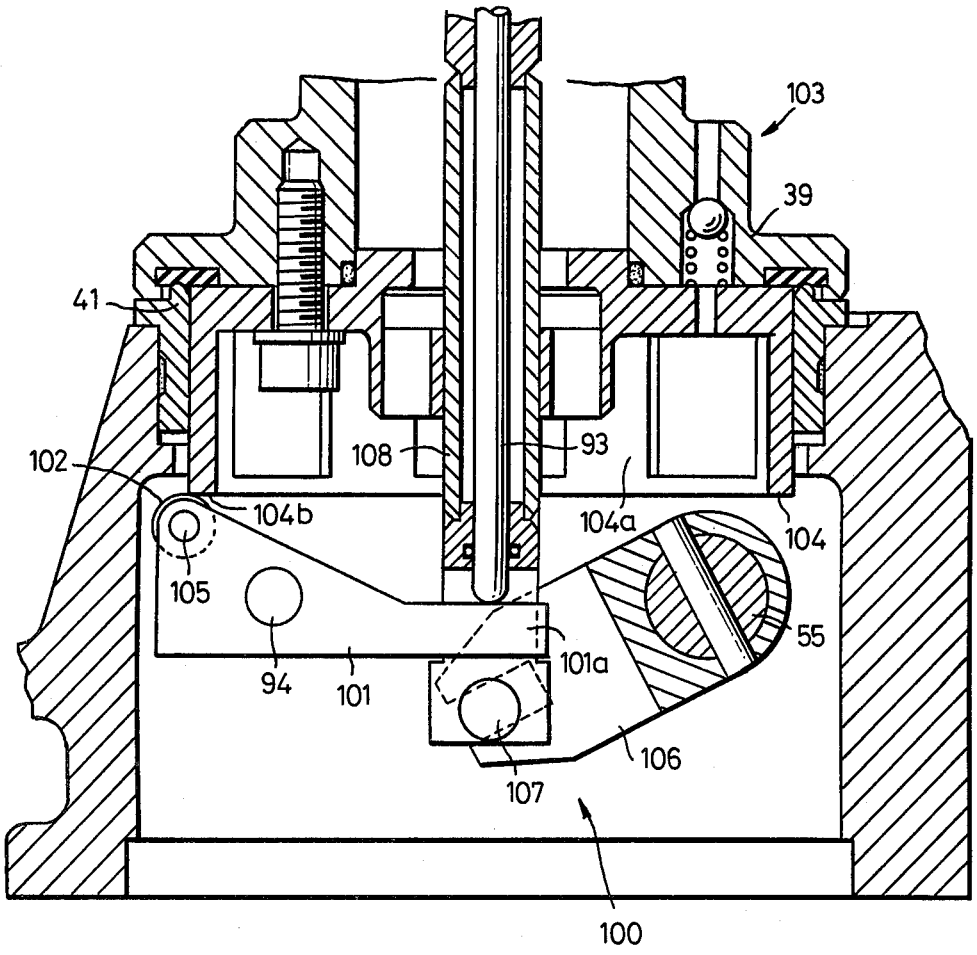

FIGS. 10 and 11 respectively show another embodiment of a second lock releasing mechanism of the overflow preventing valve apparatus according to the present invention. In these FIGS. 10 and 11, those parts which are the same as those corresponding parts in FIG. 3 are designated by like reference numerals, and their description will be omitted.

A second lock releasing mechanism 100 is substantially the same as the above described second lock releasing mechanism 71 except for a roller 102 provided at on end of a rotary arm 101, and for the fact that a ring-shaped rib structure 104 which constructs a main valve 103 pushes the roller 102.

During a fluid supplying operation, the main valve 103 is moves upwards and is in an open state. This main valve 103 consists of the valve body 39 and the ring-shaped rib structure 104. The ring-shaped rib structure 104 comprises a plurality of openings 104*a* at the periphery thereof, and is provided with a ring part 104*b* at the lower end thereof. An arm part 101*a* of the rotary arm 101 is pushed by the lower end of the long and narrow rod 93. Thus, the rotary arm 101 is rotated towards the clockwise direction with respect to the pin 94, to a rotational position indicated in FIG. 10. A pin 105 provided freely rotatable on the roller 102 is at a position directly above the ring part 104*b*. The rotary arm 101 is provided at a height position such that the rotary arm 101 is directly operated by the ring-shaped rib structure 104 upon closing of the main valve 103.

Moreover, a rotary arm 106 is rotated towards the clockwise direction, and a pipe body 108 which is connected to the rotary arm 106 by a pin 107 is moved upwards.

When the stop valve is closed and the supply of fluid is stopped, the main valve 103 moves downwards and closes as shown in FIG. 11. At the final valve closing stage of the main valve 103, the ring part 104*b* of the ring-shaped rib structure 104 pushes the roller 102. Accordingly, the rotary arm 106 is rotated towards the counterclockwise direction and the long and narrow rod 93 is pushed upwards, to release the lock with respect to the pilot valve 50 by the lock mechanism 62 shown in FIG. 3.

As the above rotary arm 101 is pushed by the ring part 104*b* and rotated towards the clockwise direction, the roller 102 moves towards the outer peripheral direction of the ring part 104*b*. However, since the roller 102 rolls over the lower surface of the ring part 104*b*, the force of friction introduced at this part is very small. Therefore, the rotary arm 101 is smoothly and positively rotated in accordance with the opening operation of the main valve 103.

In addition, since the rotary arm 101 is pushed by the ring-shaped rib structure 104 itself, the rod 90 shown in FIG. 3 is not required. Moreover, a part of the ring part 104*b* of the ring-shaped rib structure 104 always pushes the roller 102 regardless of the mounting position of the main valve 103 along the circumferential direction. Hence, there is no need to align the position of the main valve along the circumferential direction with the rotary arm 101 upon assembling of the valve, and the assembling operation can accordingly be simplified.

Further, the present invention is not limited to these embodiments, but various variations and modifications may be made without departing from the scope of the invention.

What is claimed is:

1. An overflow preventing valve apparatus comprising:

a valve main body provided at a terminal end of a fluid supplying passage, said valve main body comprising drop pipe means and fluid level detection pipe means;

a main valve fixed to a separating membrane stretched within said valve main body to separate an upper chamber and a lower chamber, said upper chamber being coupled to said fluid supplying passage through throttle valve means, said lower chamber being coupled to said fluid supplying passage and said drop pipe means, said main valve being movable according to a pressure difference between said upper and lower chambers and allowing fluid to flow to said drop pipe means from said fluid supplying passage in an open state;

a pilot valve provided in said main valve, said pilot valve being opened upon starting of a fluid supplying operation and opening said main valve by allowing fluid within said upper chamber to flow to said drop pipe means;

a lock mechanism for locking said pilot valve in the open state, said lock mechanism comprising stopping balls fitted into holes which are provided in radial directions of said pilot valve, a needle urging said stopping balls to move radially outward, and a stopping part provided at a part of said valve main body, for stopping said stopping balls which are urged to move radially outward, said pilot valve locked by said locking mechanism being released and closed when said needle is displaced so that said stopping balls become movable radially inward;

a first lock releasing mechanism responsive to said fluid level detection pipe means, for displacing said needle according to a predetermined fluid level detected by said fluid level detection means and releasing said pilot valve locked by said lock mechanism to close said pilot valve; and a second lock releasing mechanism responsive to stoppage of fluid supply, for displacing said needle according to closing of said main valve due to pressure reduction in said lower chamber caused by the stoppage of the fluid supply and releasing said pilot valve locked by said lock mechanism to close said pilot valve.

2. An overflow preventing valve apparatus as claimed in claim 1 in which said needle of said lock mechanism comprises a tapered surface for urging said stopping balls to move radially, and a narrow diameter part for allowing said stopping balls to move radially inwards.

3. An overflow preventing valve apparatus as claimed in claim 1 in which said first lock releasing mechanism comprises a diaphragm fixed to an upper end of said needle, and first and second chambers separated by said diaphragm, said diaphragm being movable according to a pressure difference between said first and second chambers to displace said needle.

4. An overflow preventing valve apparatus as claimed in claim 1 in which said second lock releasing mechanism comprises a rod inserted freely movable within a center penetrating hole of said pilot valve, said rod opposing said needle at an upper end thereof, and an upwardly displacing mechanism for upwardly displacing said rod to upwardly displace said needle upon closing operation of said main valve.

5. An apparatus as claimed in claim 4 in which said upwardly displacing mechanism comprises a rotary arm provided at a part of said valve main body in a freely rotatable manner within a vertical plane, and a holding member for pushing the other and side of said rotary arm upon closing operation of said main valve so as to rotate said rotary arm to move said rod towards the upward direction.

6. An apparatus as claimed in claim 5 in which said rotary arm is provided with a roller at a position where said rotary arm is pushed by said holding member.

7. An apparatus as claimed in claim 5 in which said holding member is a hanging rod fixed to said main valve in a hanging manner.

8. An apparatus as claimed in claim 5 in which said holding member is a ring part provided at a lower end side of a ring-shaped rib structure constituting a part of said main valve.

* * * * *